United States Patent [19]

Jenni

[11] 4,005,903

[45] Feb. 1, 1977

[54] SEAT WITH AN ADJUSTABLE BACK

[76] Inventor: Albert Jenni, Schaftmuttweg 92, Binningen, Switzerland, CH-4102

[22] Filed: Sept. 4, 1975

[21] Appl. No.: 610,490

[30] Foreign Application Priority Data

Sept. 6, 1974 Switzerland ..... 12182/74

[52] U.S. Cl. ..... 297/328; 297/355; 297/361

[51] Int. Cl.[2] ..... A47C 1/02

[58] Field of Search ..... 297/354, 355, 361, 457, 297/285, 396, 397, 312, 313, 320, 325–328, 308, 309

[56] References Cited

UNITED STATES PATENTS

| | | | |
|---|---|---|---|
| 2,450,654 | 10/1948 | Gleitsman et al. | 297/355 |
| 2,725,096 | 11/1955 | Granby | 297/457 |
| 3,643,997 | 2/1972 | Gilbert et al. | 297/457 X |
| 3,744,844 | 7/1973 | Nomaki et al. | 297/355 |
| 3,807,796 | 4/1974 | Wirges | 297/355 |
| 3,902,754 | 9/1975 | Braeuning | 297/355 X |

FOREIGN PATENTS OR APPLICATIONS

| | | | |
|---|---|---|---|
| 1,512,830 | 1/1968 | France | 297/455 |

*Primary Examiner*—Ramon S. Britts
*Assistant Examiner*—William E. Lyddane
*Attorney, Agent, or Firm*—Ladas, Parry, Von Gehr, Goldsmith & Deschamps

[57] ABSTRACT

An adjustable chair the structure of which features a supporting structure, a thigh supporting frame which is rigidly connected to the supporting structure, a buttocks support which is pivotally connected to the supporting structure, a back frame rigidly affixed to the buttocks support at an angle thereto, the buttocks each pivotal each pivotal connection from support being adjustably connected to the thigh supporting frame by laterally spaced pivotal connections for adjusting the inclination of the buttocks support relative to the thigh supporting frame, a unitary, taut resilient covering which is disposed upon and interconnects with both the thigh supporting frame and buttocks support, said covering having cut out portions in the area of the buttocks support adjacent each pivotal connection and extending from the back frame to a portion of the thigh support frame adjacent each pivotal connection whereby when said buttocks support adjacent each pivotal connection and extending from the back frame to a portion of the thigh supporting frame adjacent each pivotal connection is in its lowermost position said resilient covering is less taut than when said buttocks support is in its uppermost position.

2 Claims, 3 Drawing Figures

SEAT WITH AN ADJUSTABLE BACK

Figure 1:
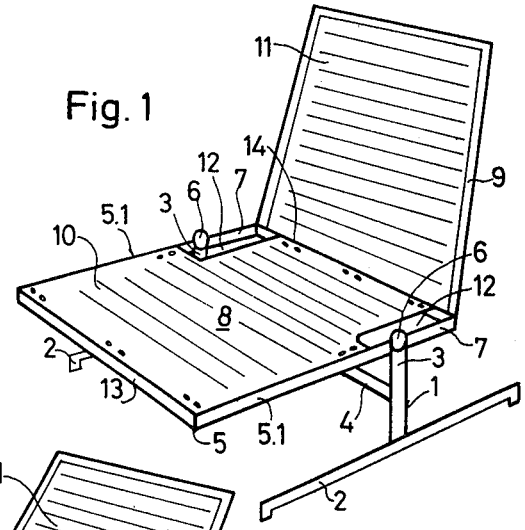

The invention relates to a seat with an adjustable back and a thigh-supporting frame which is rigidly connected to the supporting structure of the piece of furniture and which supports the front portion of the seating surface.

The desire to make seats usable other than in a single position has already long ago led to constructions in which a position of the body, which is preferred at the moment, can be achieved by selection of a specific inclination of the back in the loaded or unloaded state of the piece of furniture. In recent times it has become usual also to move a portion of the seating support together with the alteration of the position of the back, in that the supporting elements for these sections of the piece of furniture which support the body are connected to one another either rigidly or through pivoting parts. In this case it is usual likewise to divide the upholstery between the seat and back sections, which are movable relatively to one another, or at least to delimit them in relation to one another by internal separating regions.

The object of the present invention is to propose a seat of the kind referred to at the beginning, with a frame construction and suspended upholstery, wherein the upholstery of the seating surface and of the back can be made continuous, and wherein no deterioration in the ergonomic properties of the piece of furniture results from the adjustment of the back.

According to the invention, the solution to this problem consists in a buttocks support which supports the rear portion of the seating surface and which is rigidly connected to the frame of the back and is pivotable, by means of an adjustable mechanism, in relation to the front portion of the seating surface, and a supporting covering of the seating surface which is prestressed in the transverse direction between the lateral longitudinal members of the thigh supporting frame, and in the longitudinal direction between the knee-joint support of the thigh supporting frame and the base of the back at the buttocks support.

Figure 2:
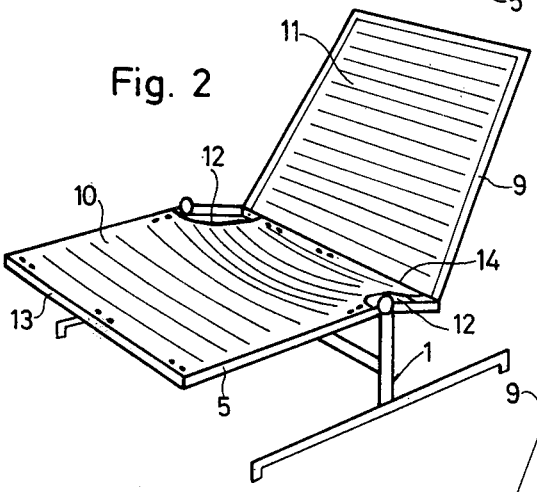
Figure 3:
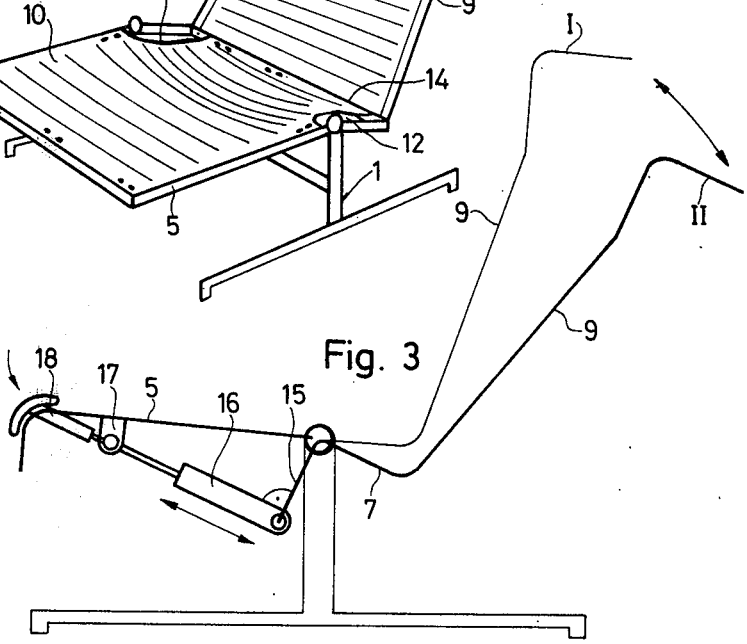

Examples of embodiment are described below with reference to the drawing. In this:

FIG. 1 shows a diagrammatic illustration of a single-seating seat with the features of the invention, with the back inclined "normally" and a plane seating surface, FIG. 2 shows the seat of FIG. 1 with the back inclined to the extreme rear and rear section of the seating surface lowered, and FIG. 3 shows an embodiment of the adjusting mechanism of a seat as shown in FIG. 1, illustrated diagrammatically.

In FIG. 1, 1 designates, in general, the supporting structure of a seat with floor rests 2, columns 3, connection web 4 and thigh supporting frame 5. The latter is rigidly connected to the columns 3 at the upper ends thereof. Likewise in the region of the upper ends of the columns 3 are pivotal bearings 6, in which the buttocks support 7 of the seating surface 8 and the back frame 9, which is made integral with the buttocks support, can be swung downwards towards the rear. FIG. 2 shows the back, together with the buttocks support 7 as the rear section of the seating surface, in the backward and downward pivoted position.

In FIGS. 1 and 2, the upholstery is omitted for reasons of clarity. On the other hand a supporting covering of the seating surface 8 is designated by 10 and the covering of the back frame is designated by 11, of which at least the supporting covering 10 consists of a flat material which is elastically resilient lengthwise and crosswise. This is provided with cut-out portions 12 at the side of the buttocks surface opposite the buttocks support 7, at least in the region of the pivotal bearing 6, in order to form a relatively soft buttocks surface when the back is swung back. An upholstery cover, which can be made in one piece but which is not shown, is placed over the supporting covering 10 and the back-frame covering 11, and may be connected to parts of the seat frame 5, 7 and of the back frame 9, and/or to said coverings.

In order to achieve the required resilient characteristics, particularly of the supporting covering 10, this is prestressed both in the transverse direction, that is to say between the two lateral longitudinal members 5.1, and in the longitudinal direction between the knee-joint support 13 and the base of the back 14, so that when the piece of furniture is in the normal position, that is to say when the thigh supporting frame 5 and the buttocks support 7 are in the same plane (FIG. 1) and when the piece of furniture is in the unloaded state, there is a completely plane surface with suitable compressive strength. This results in a relatively hard upholstery cover with the back in this position.

When the back is swung into the position shown in FIG. 2, the distance between the knee-joint support 13 and the base of the back 14 becomes shorter as a result of which the longitudinal tension in the supporting covering 10 is reduced and a soft surface results, particularly in the region of the buttocks surface. As a result, there is a gentle transition between the rear end of the buttocks surface and the base of the back 14 and hence an ergonomically advantageous support for the buttocks and back portion of the user of the piece of furniture.

In order to have infinitely variable adjustment for the most appropriate inclination in order to achieve optimum sitting comfort in the sitting position, according to FIG. 3 an adjusting mechanism can be used which comprises a lever arm 15 rigidly connected to the buttocks support 7, a gas spring 16 which is articulately connected to the free end of this level arm, a gas-spring suspension 17 which is connected to the thigh supporting frame 5, and a control mechanism 18, which latter serves for the follow-up control of the gas spring 16 during the execution of changes in inclination of the back 9, shown in the two end positions I and II. The control mechanism is preferably constructed so that the adjusting mechanism can be actuated by hand or by thigh pressure.

I claim:

1. An adjustable seat comprising a supporting structure, a thigh supporting frame which is rigidly connected to said supporting structure, a buttocks support which is pivotally connected to said supporting structure by laterally spaced pivotal connections, a back frame rigidly affixed to said buttocks support at an angle thereto, said buttocks support being connected to the thigh supporting frame by a means for adjusting the inclination of the buttocks support relative to the thigh supporting frame, a unitary, taut resilient covering which is disposed upon and interconnects with both the thigh supporting frame and the buttocks support, said covering having cut out portions in the area of the buttocks support adjacent each pivotal connection and extending from the back frame to a portion of the thigh supporting frame adjacent each pivotal connection whereby said buttocks support is in its lowermost position said resilient covering is less taut than when said buttocks support is in its uppermost position.

2. An adjustable seat as in claim 1 wherein said means for adjusting includes a gas spring which controls the inclination of the buttocks support relative to the thigh supporting frame, whereby said gas spring creates an elastic flexible connection between said thigh supporting frame and said buttocks support.

* * * * *